US005556368A

United States Patent [19]

Akin

[11] Patent Number: 5,556,368

[45] Date of Patent: Sep. 17, 1996

[54] EXERCISE APPARATUS

[76] Inventor: Ted R. Akin, 1332 Garden Ter., Irving, Tex. 75060

[21] Appl. No.: 325,065

[22] Filed: Oct. 19, 1994

[51] Int. Cl.[6] ..... A63B 21/02

[52] U.S. Cl. ..... 482/124; 482/46; 482/121; 482/126

[58] Field of Search ..... 482/121, 122, 482/124, 126, 125, 46, 91, 114, 120

[56] References Cited

U.S. PATENT DOCUMENTS

| | | | |
|---|---|---|---|
| D. 320,054 | 9/1991 | Yanazaki . | |
| 725,876 | 4/1903 | Roche . | |
| 741,966 | 10/1903 | Hernsheim . | |
| 1,698,831 | 1/1929 | Titus . | |
| 3,068,001 | 12/1962 | Portman . | |
| 3,117,781 | 1/1964 | Vargo . | |
| 3,119,614 | 1/1964 | Berry . | |
| 3,204,955 | 9/1965 | Quire et al. . | |
| 3,256,015 | 6/1966 | Perrin . | |
| 3,442,513 | 5/1969 | Fisher . | |
| 3,743,280 | 7/1973 | Martinez . | |
| 3,910,573 | 10/1975 | Jamba et al. . | |
| 4,059,265 | 11/1977 | Weider et al. . | |
| 4,282,274 | 8/1981 | Boothe . | |
| 4,417,726 | 11/1983 | Schleis . | |
| 4,466,612 | 8/1984 | Marczewski | 482/120 |
| 4,733,862 | 3/1988 | Miller . | |
| 4,736,946 | 4/1988 | Gordon . | |
| 4,793,609 | 12/1988 | Coutts et al. . | |
| 5,004,228 | 2/1991 | Powers . | |
| 5,029,850 | 7/1991 | Van Straaten | 482/122 |
| 5,060,933 | 10/1991 | Cedro . | |
| 5,125,649 | 6/1992 | Fuller . | |
| 5,131,650 | 7/1992 | Hall . | |
| 5,137,503 | 8/1992 | Yeh . | |
| 5,290,209 | 3/1994 | Wilkinson | 482/121 |

*Primary Examiner*—Lynne A. Reichard
*Attorney, Agent, or Firm*—John E. Vandigriff

[57] ABSTRACT

An exercise apparatus has a first bar with two side bars, each side bar extending generally perpendicular from and attached adjacent to the opposite ends of the first bar. The first bar is rotatably mounted with respect to the side bars. A second bar is connected to said side bars of said first bar by one or more loops of cord. Adjustment devices are used in conjunction with the cord to adjust the distance between the first bar and the second bar. Accessory straps may be used in conjunction with the first bar to perform various exercises.

2 Claims, 5 Drawing Sheets

EXERCISE APPARATUS

PRIOR APPLICATION

EXERCISE APPARATUS AND METHOD

Ser. No. 08/085,231,

Filed Jul. 9, 1993

Inventor Ted R. Akin

Now abandoned.

FIELD OF THE INVENTION

The present invention relates to an exercise apparatus, and more particularly to an exercise apparatus that includes a first bar with two side bars, one side bar adjacent to each end of the first bar, and to other accessories including one or more bars attached by a non-elastic cord, and straps used with the side bars, all of which enable the user to stretch, tone and strengthen all muscle groups with several multi-dimensional exercises.

BACKGROUND OF THE INVENTION

U.S. Pat. No. 4,284,274 to Boothe discloses an 'Exercise Device' which utilizes a pair of bars, one each for the two persons exercising with the device and a tension member between the bars. The tension member is of such length so that, when two persons exercising are foot-to-foot and each person grasping his respective bar, one exerciser is supine and the other is bent forward to a toe-touching angle. With each pulling on his respective bar and a swivelling on the hip joints, the exercising persons alternate supine positions. Boothe ('274) provides exercise but requires the presence of two persons, making it inappropriate for the lone exerciser.

U.S. Pat. 5,125,649, to Fuller shows an exercise apparatus that uses a bar connected to another rigid structural member by elastic cords. Fuller's bar is a single bar without end bars, and the elastic cords are not adjustable in length. Fuller's bar is not intended to be used by itself, but only with other structural members.

A need exists for a portable, light weight exercise device that is multi-functional and can utilize several methods for the user to pit one set of muscles against another set of muscles, and usable by a single exerciser.

SUMMARY OF THE INVENTION

The present exercise apparatus is a light weight and yet sturdy device for use in doing a variety of exercises. The exercise apparatus, in a first embodiment, comprises a first bar with two side bars, each side bar extending generally perpendicular from and rigidly attached adjacent to the opposite ends of the first bar. The first bar is rotatably mounted between the side bars. A second bar is connected to said side bars of said first bar by one or more loops of a cord. Adjustment devices are used in conjunction with the cord to adjust the distance between the first bar and the second bar. The adjustment devices permit quick disconnect of the second bar and cord from the first bar.

The second bar may be a unitary bar, or may have a rotatable outer surface. Another accessory for use with the exercise apparatus is a flexible strap that attaches between the side bars and extends around the users back when the first bar is held in front of the user. A second short flexible strap may be connected to or around the side bars and attached to a finger or toe to provide simple exercise for these body parts.

The first and second bars are each between 8 and 30 inches long. The length of each side bar is between 4 and 12 inches. The diameter of all the bars is between one-half and two and one-half inches including the padded grips.

The exercise apparatus can be used in several configurations. In a first configuration, the distance between the first and second bars is adjusted to closely match the distance between the hands with the arms at the user's side and the bottom of the user's feet while he is lying flat on the floor. The user can exercise by engaging the first bar with either at least one hand or foot, engaging the second bar with the other of at least one hand or foot, and then tensioning the non-elastic cord. The user can be either standing, kneeling, sitting, or laying on the floor.

Many exercises are performed with the user laying flat on the floor while grasping the first bar in one or both hands, either with palms up or palms down. As an example, the user can perform a 'pull up' using the present device. The user lays flat on his back on the floor, both hands apart with the palms down on the first bar, legs straight and both feet apart on the second bar. The user then pulls the first bar up to touch his chin, simultaneously bending the legs to bring his knees to his chest, using the legs as resistance. He should inhale deeply as he raises the bar. He should then exhale fully as he lowers the first bar back to the starting position. He should keep his head touching the floor and move both elbows up and out beside his head as he raises the first bar to his chin. The resistance experienced by the arms is directly dependent upon the force applied by the user's legs and vice versa.

In the second configuration, the main bar is detached from the second bar and cord. The user can exercise by engaging one side bar of the main bar in one hand and the other side bar in either the other hand or against some part of the user's body, for example, the abdomen, the side of the head, or the top or bottom of the foot, or with both side bars engaged against the body, for example, between the ankles or wrists or over the outside of the knees or elbows.

Most exercises with the first configuration involve isometric resistance movement of the muscles. Most exercises with the second configuration are of the static isometric resistance type where the user holds moderate to maximum tension of the muscles against the apparatus for a period of time.

The user can repeat the chosen exercise any number of times. The dynamics of variable resistance with each repetition works to strengthen the muscles, which in turn builds and strengthens the bone mass. Performing various exercises on the floor helps to maintain spinal alignment. The total effect of the exercises cannot be duplicated by the use of free weights or conventional exercise equipment because of the unique variable resistance capability with each repetition. Likewise, the device can be used in certain unique orientations not allowed by standard weight sets. The device is light weight and very portable. It can be easily stored away when not in use and taken on trips. There are numerous exercises that can be performed with this device allowing the user to easily modify his program to place emphasis on certain muscle groups or simply to reduce the boredom of a limited routine of exercises.

The technical advance represented by the invention, as well as the objects thereof, will become apparent from the following description of a preferred embodiment of the invention when considered in conjunction with the accompanying drawings, and the novel features set forth in the appended claims.

DETAILED DESCRIPTION OF A PREFERRED EMBODIMENT

Figure 1:
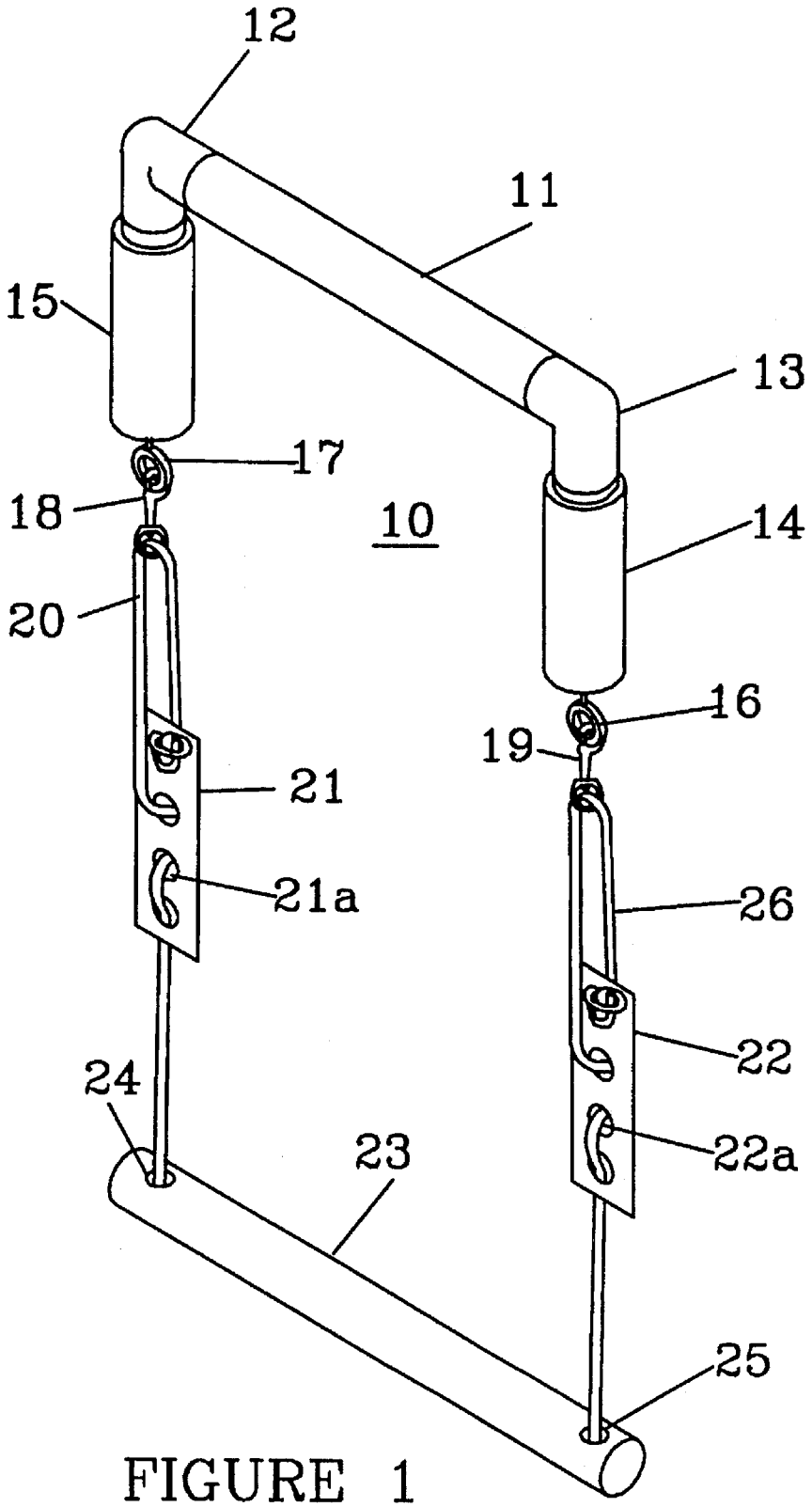
FIG. 1 is a first embodiment of the invention utilizing a first bar with side bars, detachable fasteners and a second bar.

FIG. 1 illustrates a first embodiment of the exercise apparatus which includes a main bar 10 having two side bars 14 and 15. Side bars 14 and 15 extend from and are mounted adjacent to the ends of first bar 11. Bar 11 rotates with respect to side bars 14 and 15 ( See FIG. 6). Adjacent to the ends of each side bar 14 and 15 are eyelets 16 and 17, respectively. Eyelets 16 and 17 are used to attach a second bar 23 utilizing adjustable length cords 20 and 26, or other attachments described below.

Devices 21 and 22, through which cords 20 and 26 are inserted, are used to adjust the length of cords 20 and 26, and the spacing of bar 23 from bar 11. Adjustment devices 21 and 22 include holes 21*a* and holes 22*a*, respectively. A knot is tied on one end of cord 20 to secure it to the top hole 21*a* in adjustment device 21. A loop is formed in cord 20 to secure it to the end of clip 18. Cord 20 is then threaded through the other three holes in adjustment device 21 and then through opening 24 in bar 23. Cord 20 can be adjusted along its length through the openings 21*a*, and once in place, adjustment device 21 will hold cord 20 in its adjusted position when cord 20 is pulled in a direction along its length. Cord 26 is arranged in device 22 through holes 22*a*, clip 19 and opening 25 in bar 23, the same as cord 20, is in adjustment device 21, clip 18 and opening 24 in bar 23.

The exercise apparatus of FIG. 1 is constructed in separable pieces so that the apparatus can be used in several configurations. For example, with clips 18 and 19 detached from eyelets 17 and 16, main bar 10 can be utilized to perform various exercises. Second bar 23 can then be attached by clips 18 and 19, and the lengths of cords 20 and 26 adjusted to a desired length, and the combination of bars 11 and 23 used to perform additional exercises.

Figure 2:
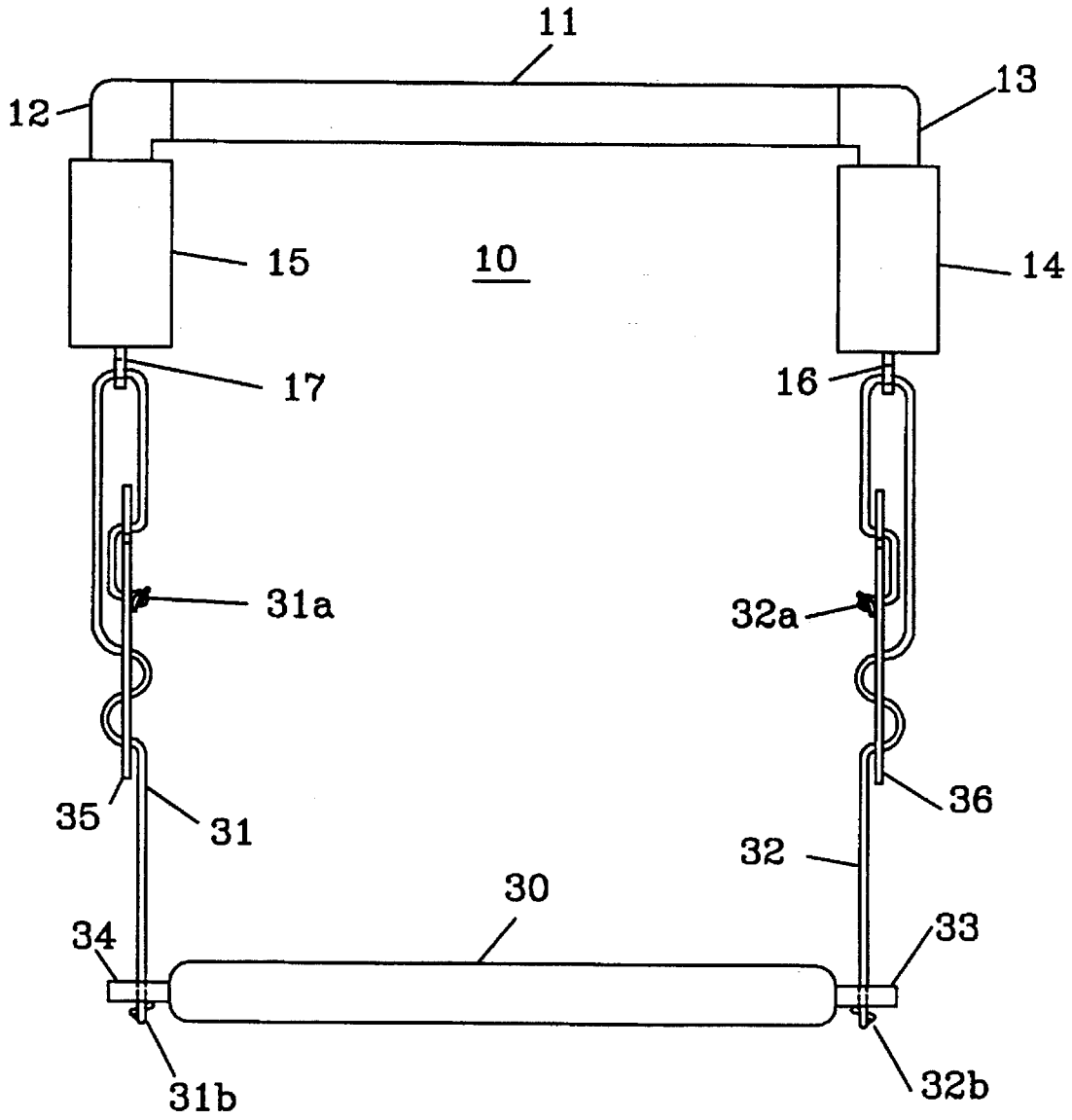
FIG. 2 is a second embodiment of the invention using adjustment devices in conjunction with the attachment cords and a second bar.

FIG. 2 is a front view of main bar 10 attached to cords which utilize another embodiment of adjustment devices and a second embodiment for a second bar 30. Main bar 10 has two side bars 14 and 15 attached to the ends of bar 11. Bar 11 rotates with respect to side bars 14 and 15 (See FIG. 6). An eyelet 17 is in the end of side bar 15, and eyelet 16 is in the end of side bar 14. Eyelets 16 and 17 have an eyelet opening of a diameter such that a simple knot, such as knots 31a and 32a will pass through the eyelet openings. Two cords, 31 and 32, are used to attach bar 30 to bar 10.

The distance between bars 10 and 30 is adjusted by changing the effective length of cords 31 and 32 through identical adjustment devices 35 and 36. These adjustment devices differ from the adjustment devices of FIG. 1 in that bar 30, along with cords 31 and 32 may be detached from the ends of side bars 14 and 15 without the use of clips. Attachment to each side is the same, and as an example, attachment of one end of bar 30 to eyelet 17 is as follows. Cord 31 is threaded through three holes 39*a*, 39*b*, and 39*c* (see FIG. 4) lacing the cord through alternate sides of adjustment device 35.

After cord 31 is laced through holes 39*a* 39*b* and 39*c*, a simple or half knot 31*a* is tied at one end of cord 31, and is looped through the end of eyelet 17. Cord 31 is then threaded through angled slots 37 and 38 (FIG. 4) in device 35. Knot 31*a* secures the end of cord 31 in angled slot 38. The other end of cord 31 is secured to one end of bar 30. In FIG. 2, a knot 31*b* is used to secure cord 31 to end 34 of bar 30. Side bar 14 is secured to end 33 of bar 30 in a similar manner. Cord 32 is laced through openings in device 36 and one end of cord 32 is secured in adjustment device 36 by knot 32*a* in angled slot 38. Knot 32*b* secures cord 32 to end 33 of bar 30.

Figure 3:
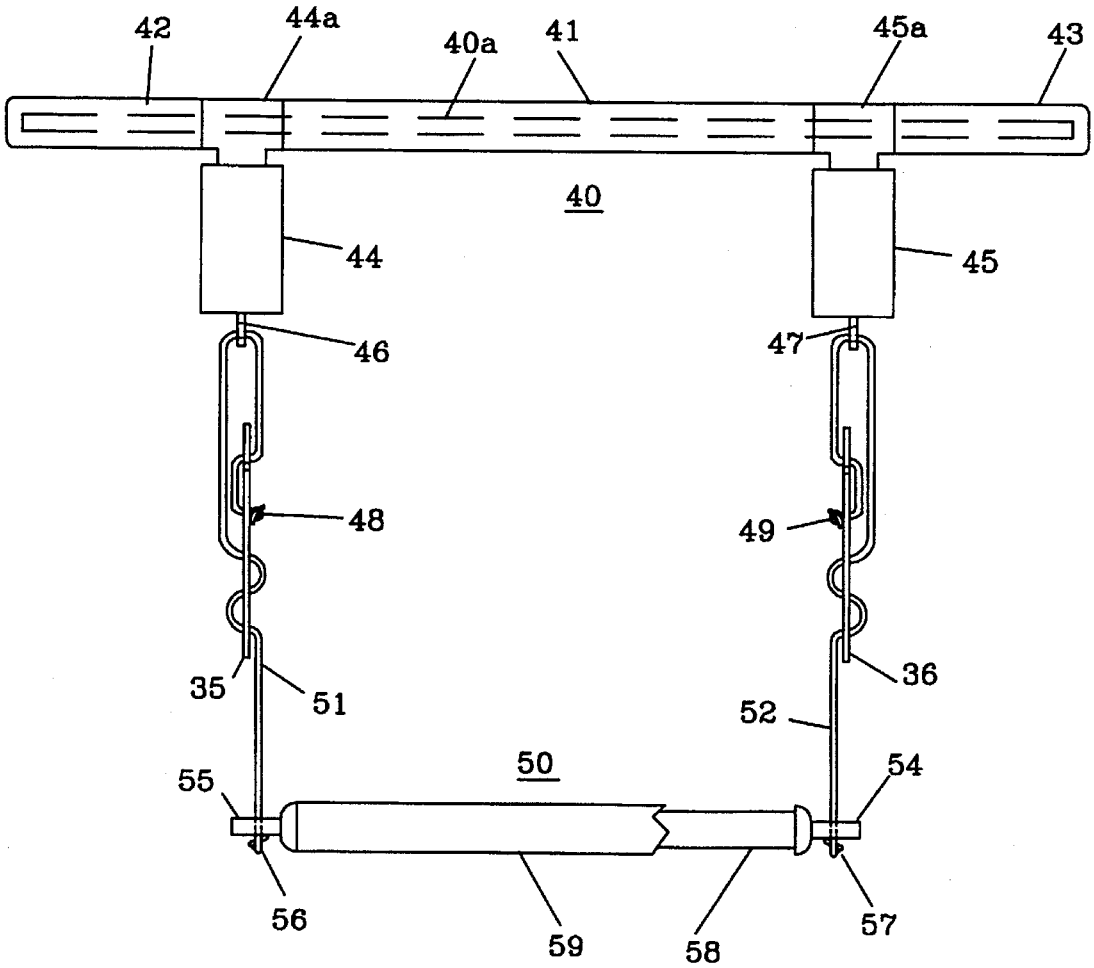
FIG. 3 is a third embodiment of the invention utilizing an alternate design for both the first bar and the second bar in conjunction with the attachment cords.

FIG. 3 shows a third embodiment of a main bar and a second bar connected together by detachable cords. Main bar 40 has a central portion 41 with ends 42 and 43. Two side bars 44 and 45 are rotatably mounted on main bar 40, side bar 44 is mounted between central portion 41 and end 42, and side bar 45 is mounted between central portion 41 and end 43. Main bar 40 rotates with respect to parts 44*a* and 45*a* of side bars 44 and 45 respectively. In an alternative embodiment of the main bar of FIG. 3, side bars 44 and 45 may be securely attached to a central member 40*a* extending the full length of the main bar 40 with central bar 41 and ends 42 and 43 rotatably mounted over the longitudinal axis of the central member 40*a*.

Eyelets 46 and 47, attached to side bars 44 and 45, respectively, each have an eyelet opening of a diameter such that a simple knot, such as knots 48 and 49 will pass through the eyelet opening. Two cords, 51 and 52, are used to attach bar 50 to bar 40. The distance between bars 50 and 40 is adjusted by changing the effective length of cords 51 and 52 through adjustment devices 35 and 36. Attachment to each side is the same, and as an example, attachment of one end of bar 50 to eyelet 46 is as follows. Cord 51 is threaded through three holes (see FIG. 4) lacing the cord through alternate sides of adjustment device 35.

After cord 51 is laced through the three holes, a simple or half knot 48 is tied at one end of cord 51, and is looped through the end of eyelet 46. Cord 51 is then threaded through angled slots 37 and 38 (FIG. 4) in device 35. Knot 48 secures the end of cord 51 in angled slot 38. The other end of cord 51 is secured to one end 55 of bar 50 by knot 56.

Cord 52 is laced through openings in device 36 and one end of cord 52 is secured in adjustment device 36 by knot 49 after passing through eyelet 47. Knot 57 secures cord 52 to end 54 of bar 50.

Bar 50 has a central member 58 that is rigidly attached to ends 54 and 55. A rotatable member 59 is co-axial with member 58 and rotates around member 58.

Figure 4:
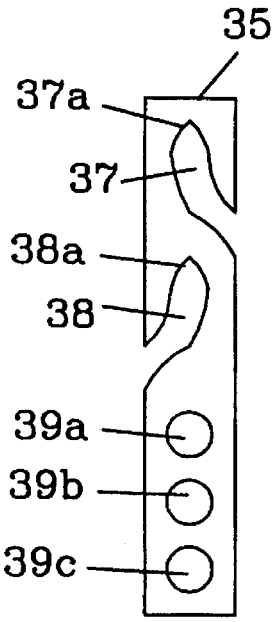
FIG. 4 is a front view of the attachment device.
Figure 5:
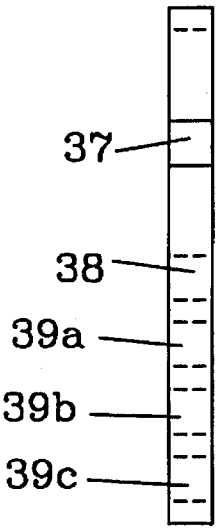
FIG. 5 is an edge view of the attachment device.

FIGS. 4 and 5 are front and edge views, respectively, of attachment device 35 (and 36). Attachment device 35 is a flat, thin plate having three holes 39*a*, 39*b* and 39*c* extending through device 35. Two angled slots 37 and 38, with tapered ends 37*a* and 38*a*, respectively, extend from opposite edges of device 35. Cord 31, (FIG. 2) is placed into slots from the edges of device 35, and knot 31*a* secures the end of cord 31 in slot 38 as shown in FIG. 2.

Figure 6:
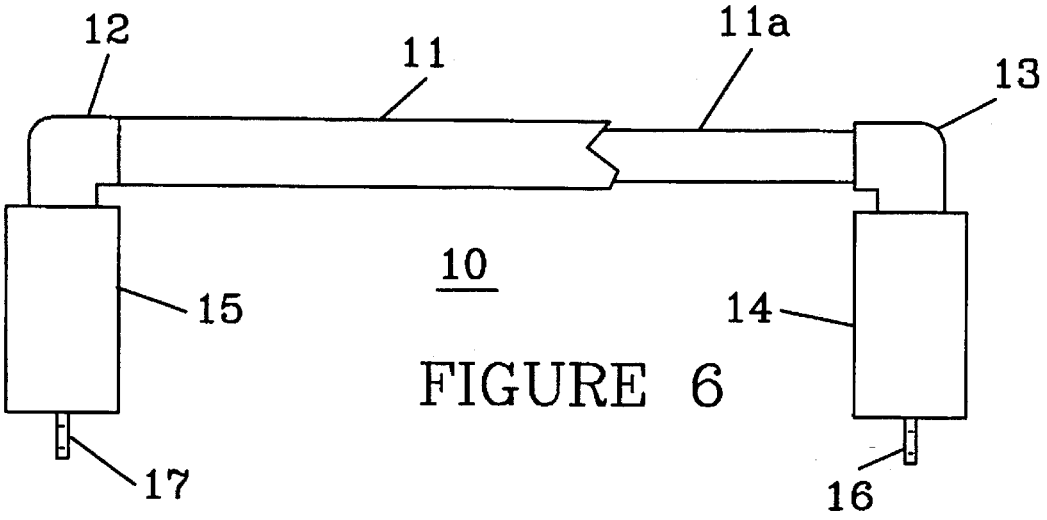
FIG. 6 illustrates the rotatable construction of the first bar.

FIG. 6 shows exercise apparatus main bar 10, in which first bar 11 is rotatably mounted on inner bar 11*a*. Inner bar 11*a* is rigidly attached adjacent to the ends 12 and 13, which in turn are rigidly attached to side bars 15 and 14, respectively. As the user is exercising with the exercise apparatus (FIG. 1), the feet may be placed on second bar 23 with the hands grasping bar 11. Depending upon the movement and position of the bar 11 with respect to the exerciser's body, feet and hands, bar 11 may rotate so that the side bars 14 and 15 are in line with cords 20 and 26. If bar 11 did not rotate with respect to the side bars, the exerciser would have to allow bar 11 to rotate in his hands, loosing the grip of the hands on bar 11 in the process. With a rotating bar 11, the hand grip does not have to be loosened to allow alignment of side bars 14 and 15 with cords 20 and 26.

Figures 7, 8:
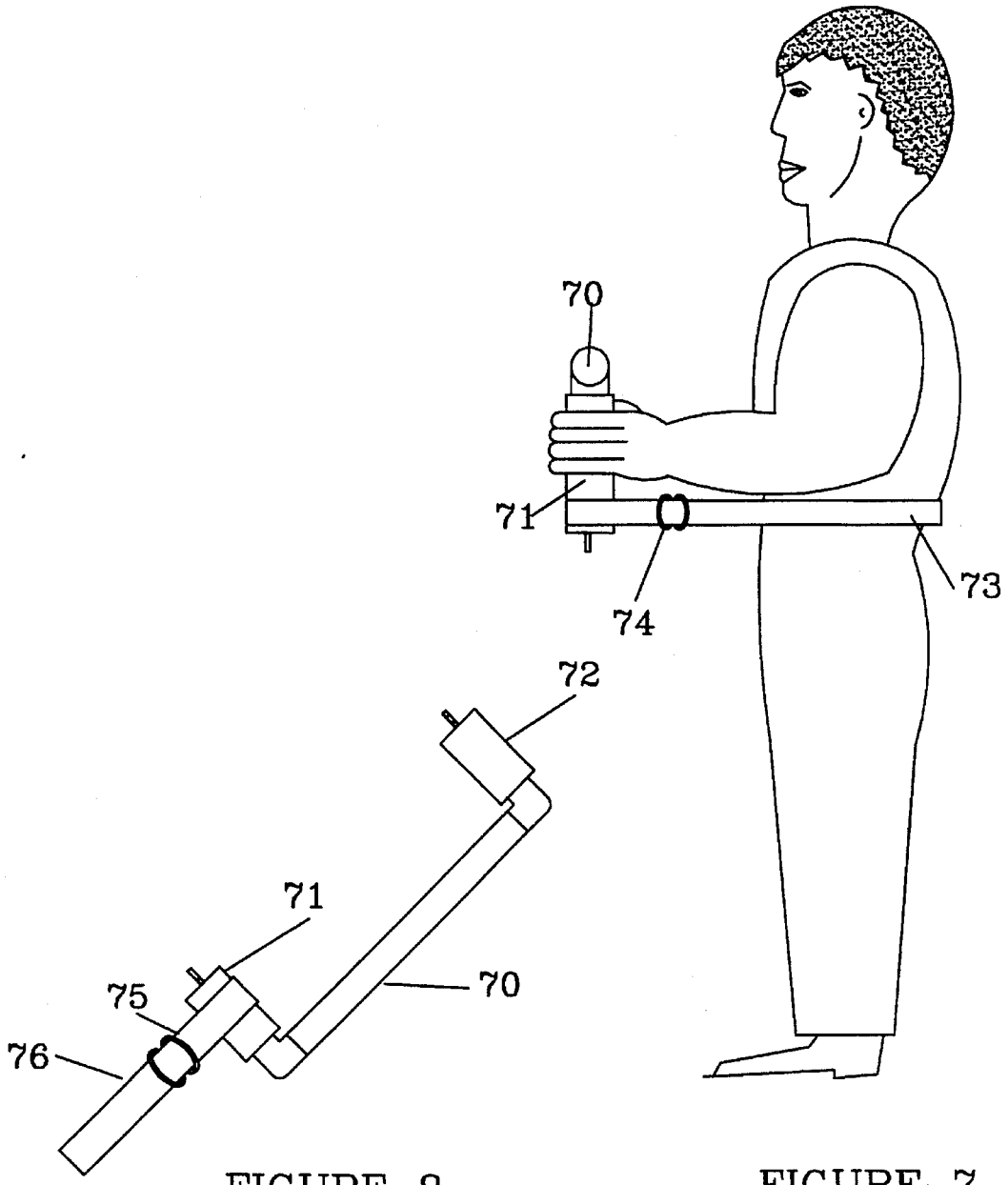
FIG. 7 shows a main bar in combination with a strap that extends around the user's back.
FIG. 8 shows a main bar with a strap used in conjunction with finger and toe exercises.

FIG. 7 shows a first bar 70 with a strap 73 around side bar 71. Strap 73 is adjustable in length by adjustment device 74 and is used, for example, by extending strap 73 around a user's back while bar 70 is positioned in front of the user's body and held by side bars 71 and 72 in user's hands (FIG. 7).

FIG. 8 shows first bar 70 with side bars 71 and 72 with strap 75 having two loops, one on each end. The first loop is attached around side bar 71. The second loop in strap 75 may be adjusted in size by adjustment device 76. This configuration of first bar 70 and strap 75 may be used, for example, in the exercise of the fingers and toes. Side bar 72 is held in one hand while strap 75 is looped around an individual finger or toe, and tension is applied.

Although preferred embodiments of the invention have been described in the foregoing detailed description, and illustrated in the accompanying drawings, it will be understood that the invention is not limited to the embodiments disclosed, but is capable of numerous rearrangements, modification, and substitutions of parts and elements without departing from the spirit of the invention.

Accordingly, the present invention is intended to encompass such rearrangements, modifications and substitutions of parts and elements as fall within the scope of the invention.

What is claimed:

1. A hand held exercise apparatus comprising;

a first bar having first and second ends, and a longitudinal axis, an outer rotatable surface on said first bar rotatable over the longitudinal axis;

a pair of side bars with a hand grip integral with each of said side bars, each side bar having first and second ends, said first end of one of said pair of side bars is attached adjacent to the first end of said first bar, and said first end of the other of said pair of side bars is attached adjacent to the second end of said first bar, said side bars oriented perpendicular to said first bar;

a pair of attachment points, one each adjacent to the second end of each of said pair of side bars; and at least one accessory device for attaching to said side bars to be used in conjunction with said first bar and pair of side bars to perform exercises additional and supplemental to exercises performed solely with the first bar and side bars.

2. The exercise apparatus according to claim 1, wherein said at least one accessory device is a second bar attached to the attachment points of said side bars by at least one portion of non-elastic cord, including at least one adjustment device for both securing one end of said non-elastic cord, and adjusting and securing the length of said non-elastic cord.

* * * * *